US007861336B2

(12) United States Patent
Patterson et al.

(10) Patent No.: US 7,861,336 B2
(45) Date of Patent: Jan. 4, 2011

(54) TABLE ASSEMBLY FOR PATIENT TRANSFER DEVICE

(75) Inventors: Richard A. Patterson, Georgetown, TX (US); Lawrence R. Gravell, Austin, TX (US)

(73) Assignee: ConMediSys, Inc., Austin, TX (US)

( * ) Notice: Subject to any disclaimer, the term of this patent is extended or adjusted under 35 U.S.C. 154(b) by 522 days.

(21) Appl. No.: 11/837,671

(22) Filed: Aug. 13, 2007

(65) Prior Publication Data

US 2008/0022456 A1 Jan. 31, 2008

Related U.S. Application Data

(63) Continuation-in-part of application No. 11/534,535, filed on Sep. 22, 2006, now Pat. No. 7,540,044, which is a continuation-in-part of application No. 11/246,426, filed on Oct. 7, 2005, now Pat. No. 7,603,729.

(51) Int. Cl.
*A61G 7/10* (2006.01)

(52) U.S. Cl. ..... 5/81.1 C; 5/81.1 HS; 5/81.1 R

(58) Field of Classification Search ..... 5/81.1 R, 5/81.1 C, 81.1 HS; 414/921; 198/321
See application file for complete search history.

(56) References Cited

U.S. PATENT DOCUMENTS

| | | | | |
|---|---|---|---|---|
| 2,480,737 | A | 8/1949 | Jayle | |
| 3,213,882 | A | 10/1965 | Beatty | |
| 3,854,152 | A * | 12/1974 | Chez | 5/81.1 C |
| 3,947,902 | A | 4/1976 | Conde et al. | |
| 4,019,772 | A | 4/1977 | Lee | |
| 4,073,016 | A * | 2/1978 | Koll | 5/81.1 C |
| 4,297,753 | A | 11/1981 | Langren | |
| 4,658,451 | A * | 4/1987 | Taniguchi | 5/607 |
| 4,803,744 | A | 2/1989 | Peck et al. | |

(Continued)

FOREIGN PATENT DOCUMENTS

| | | |
|---|---|---|
| DE | 10023729 | 1/2002 |

OTHER PUBLICATIONS

MLA AT-2000 Patient Transfer System [online], from the Internet URL: http://www.ssl.gb.com/knight/mla_stretchairs.htm (2003).

(Continued)

*Primary Examiner*—Michael Trettel
*Assistant Examiner*—William Kelleher
(74) *Attorney, Agent, or Firm*—Jack V. Musgrove

(57) ABSTRACT

A table assembly for a patient transfer device has upper and lower tables surrounded by belts which counter-rotate as the table assembly moves between a patient and a supporting surface such as a bed. The table assembly includes integrated means for laterally retracting side plates of the upper table while adjusting incident angles of the side plates and vertically separating the upper table from the lower table. Guide slots in end plates fixed to a slide assembly retain positioning posts attached to ends of the side plates. The slots are inclined upwardly toward a centerline of the table assembly at different angles. A crank moves the side plates using a rotating disk attached to a central frame of the upper table and linkage arms with one end pivotally attached to a peripheral region of the disk and another end pivotally attached to one of the positioning posts.

20 Claims, 5 Drawing Sheets

U.S. PATENT DOCUMENTS

| | | | | |
|---|---|---|---|---|
| 4,868,938 | A | 9/1989 | Knouse | |
| 4,914,769 | A * | 4/1990 | Kume et al. | 5/81.1 C |
| 4,987,623 | A | 1/1991 | Stryker et al. | |
| 5,257,425 | A | 11/1993 | Shinabarger | |
| 5,522,100 | A | 6/1996 | Schilling et al. | |
| 5,540,321 | A * | 7/1996 | Foster | 198/510.1 |
| 5,737,781 | A | 4/1998 | Votel | |
| 5,850,642 | A * | 12/1998 | Foster | 5/81.1 C |
| 5,890,238 | A | 4/1999 | Votel | |
| 5,966,754 | A * | 10/1999 | Schuster | 5/81.1 R |
| 6,611,974 | B2 * | 9/2003 | Roit et al. | 5/81.1 C |
| 6,698,041 | B2 | 3/2004 | VanSteenburg et al. | |
| 6,857,143 | B2 | 2/2005 | McNulty | |
| 7,200,881 | B2 | 4/2007 | Kasagami et al. | |
| 7,210,176 | B2 | 5/2007 | Weedling et al. | |
| 7,540,044 | B2 | 6/2009 | Patterson et al. | |
| 2001/0047543 | A1 * | 12/2001 | VanSteenburg et al. | 5/81.1 C |
| 2003/0182723 | A1 * | 10/2003 | Kasagami et al. | 5/81.1 C |
| 2007/0074343 | A1 | 4/2007 | McNulty | |

OTHER PUBLICATIONS

Linkage Mechanism Simulator [online], retrieved on December 21, 2008 from the Internet URL: http://www.edu-ctr.pref.kanagawa.jp/LinkWeb/index_e.htm.

* cited by examiner

TABLE ASSEMBLY FOR PATIENT TRANSFER DEVICE

CROSS-REFERENCE TO RELATED APPLICATION

This application is a continuation-in-part of U.S. patent application Ser. No. 11/534,535 entitled "PATIENT LIFT AND TRANSFER DEVICE" filed Sep. 22, 2006 now U.S. Pat. No. 7,540,044, which is a continuation-in-part of U.S. patent application Ser. No. 11/246,426 entitled "PATIENT LIFT AND TRANSFER DEVICE" filed Oct. 7, 2005 now U.S. Pat. No. 7,603,729, each of which is hereby incorporated.

BACKGROUND OF THE INVENTION

1. Field of the Invention

The present invention generally relates to devices for moving objects, and more particularly to a tray or table assembly for a patient transfer device wherein the table assembly includes upper and lower tables having counter-rotating, endless belts.

2. Description of the Related Art

A wide variety of products have been designed to move objects from one location to another and, in particular, transfer mobility-impaired individuals such as patients. In a hospital setting, patients must often be transported from their beds to an examination table or operating table, and back again. Basic devices for transferring patients include stretchers that are carried manually by two attendants, and wheeled gurneys that can more easily be handled by a single attendant.

There can still be problems, however, in getting a patient from a bed or other support surface onto a stretcher or gurney. If the patient is cooperative and not injured or disabled, it is a simple matter for the individual to slide over to the gurney with the assistance of a nurse, but if the patient is unconscious or has a disability or an injury (e.g., a broken bone) that might be worsened by movement, then great care must be taken in transferring the patient from the bed to the gurney. This problem is exacerbated when the patient is unusually heavy.

One solution to this problem is to slide a tray or sheet under the person and then, after the person is resting atop it, pull the tray or sheet off the bed and onto the gurney. A rigid tray can be forcibly inserted between the patient and the bed, and a sheet can be incrementally pushed under the person by first rocking him away from the gurney and then rocking back toward the gurney as the sheet is drawn under. This approach can still be difficult if the patient is uncooperative (i.e., unconscious), and can further be very uncomfortable even if the patient is cooperative, due to the frictional engagement of the tray with the body or the lack of firm support by the sheet.

Some transfer devices incorporate a rigid tray into the gurney that can move to the side and slide under a patient, and then slide back (while supporting the patient) to a centered position for transportation. In a further variation on this concept, the transfer device may use counter-rotating, endless belts to substantially eliminate friction against both the patient and the bed as support trays crawl under the patient. One example of such a design is shown in U.S. Pat. No. 5,540,321. A first endless belt surrounds a set of upper trays and a second endless belt surrounds a set of lower trays, so the portions of the belts that are in contact (between the upper and lower tray sets) move in the same direction at the same rate as they counter-rotate. As the trays are inserted under the patient, the belt on the upper tray everts outwardly at the same rate as the translational movement of the trays to crawl under the patient without introducing any significant friction, and the belt on the lower tray similarly everts along the bed sheet. Once the patient is supported by the trays, the entire tray assembly is raised off the bed and the device can be rolled on casters to transport the patient.

There are still several serious problems with the counter-rotating belt designs. The entire transfer device (including the base and support members) moves as the trays are inserted under the patient, and the base must extend under the bed or table in order to prevent the device from tipping over when the patient is carried (see, e.g., FIG. 10 of '321 patent). Because of this limitation, such devices cannot be used in all settings, i.e., wherein there is insufficient clearance space under the bed or table (a situation becoming more common as more accouterments are added to beds and tables that occupy the space underneath). These devices further only allow loading and unloading along one side of the device, which can present problems when the patient is not suitably oriented (head-to-feet) on the device with respect to the bed or table. Designs such as that shown in the '321 patent are also not particularly comfortable as there is only a thin layer of the belt interposed between the patient and the hard surface of the metal support trays. Moreover, hospitals are becoming increasingly concerned with potential contamination from patient fluids, and the prior art belt-type transfer devices are difficult if not impossible to properly clean.

Another problem relates to the initial impact of the trays as they acquire a patient. The height of the trays and the large diameter edge rollers in the '321 design present an abrupt bump along the patient's side during acquisition, and result in a similar bumpy delivery of the patient back to a support surface. The tray can be inclined, for example as shown in U.S. Pat. No. 4,914,769, but a large angle of inclination makes it more difficult to acquire the patient and can increase patient discomfort during loading and unloading. It is also more likely that a patient will roll off the table assembly if the edge portions can incline downward.

In light of the foregoing, it would be desirable to devise an improved patient transfer device that provided more flexibility in deployment while still being easy to operate and maneuver. It would be further advantageous if the device were more comfortable for the patient, yet could still maintain the patient in a stabilized manner during transport.

SUMMARY OF THE INVENTION

It is therefore one object of the present invention to provide an improved table assembly for a patient transfer device wherein the table assembly includes upper and lower tables having counter-rotating, endless belts.

It is another object of the present invention to provide such a table assembly that can adjust the upper table geometry to more easily and comfortably acquire, transport and deliver a patient.

It is yet another object of the present invention to provide a table assembly for a patient transfer device that does not require clearance space under the patient's bed or table during operation.

The foregoing objects are achieved in a patient transfer device generally comprising a base, a support member attached to the base, a slide assembly attached to the support member which is movable between a home position over the base and an extended position to a side of the base, and a table assembly attached to the slide assembly having upper and lower tables surrounded by respective upper and lower belts which counter-rotate as the table assembly moves between a patient and a surface supporting the patient, the table assembly also having integrated means for laterally retracting a pair of side plates of the upper table while vertically separating the upper table from the lower table. In one embodiment the lower table is fixed to the slide assembly, and the integrated means includes end plates attached to the slide assembly having guide slots which slidably retain positioning posts attached to ends of the side plates. The slots are inclined upwardly toward a longitudinal centerline of the table assembly. Crank assemblies for moving the side plates have rotating disks and linkage arms with a first end pivotally attached to a peripheral region of a disk and a second end pivotally attached to one of the positioning posts. The rotating disks are attached to a central frame of the upper table such that retraction of the side plate raises the central frame. The table assembly may further adjust an incident angle of the side plate as it retracts by providing guide slots having different angles of inclination. The side plate is downwardly inclined in an extended position and is generally flat in a retracted position.

The above as well as additional objectives, features, and advantages of the present invention will become apparent in the following detailed written description.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1A:
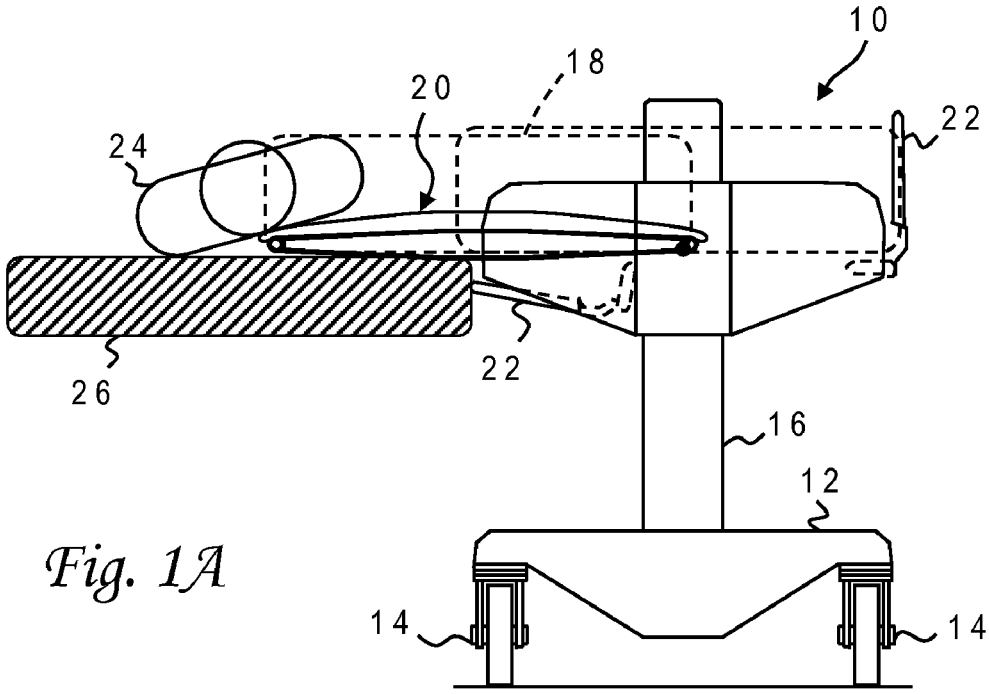
FIGS. 1A-1D are front elevational views of one embodiment of the patient transfer device of the present invention illustrating (i) patient acquisition, (ii) initial separation of the upper and lower tables of the table assembly while supporting the patient, (iii) further separation and partial retraction of the table assembly, and (iv) the separated table assembly supporting the patient at the centered (home) position for transport.

With reference now to the figures, and in particular with reference to FIGS. 1A-1D, there is depicted one embodiment 10 of a patient transfer device constructed in accordance with the present invention. Patient transfer device 10 is generally comprised of a frame or base 12 mounted on four or more wheels or casters 14, two vertical support members or columns 16 mounted on base 12, a horizontal slide assembly 18 attached to support columns 16, a table assembly 20 attached to slide assembly 18, and side rails 22 attached to support columns 16.

FIG. 1A illustrates a patient acquisition position of slide assembly 18 and table assembly 20 wherein a leading edge of table assembly 20 has crawled about halfway under the patient 24 who is resting on a bed or other support surface 26. Table assembly 20 includes an upper table 20*a* and a lower table 20*b* each of which is surrounded by a respective endless belt or web. In the patient acquisition position, upper table 20*a* is in forcible contact with lower table 20*b*, and the upper and lower belts counter-rotate. The movement of slide assembly 18 is synchronized with the belt drive mechanism so that the extending carriages slide sideways to or from the home position at a speed that matches the eversion rate of the upper and lower belts. In this manner, table assembly 20 can move under (or away from) the patient with essentially no frictional engagement between patient 24 and the upper belt, or between bed 26 and the lower belt and in doing so, only gently lift or lower the patient without pushing the patient to the side, and further performs this operation without requiring that base 12 also move sideways.

Figure 1B:
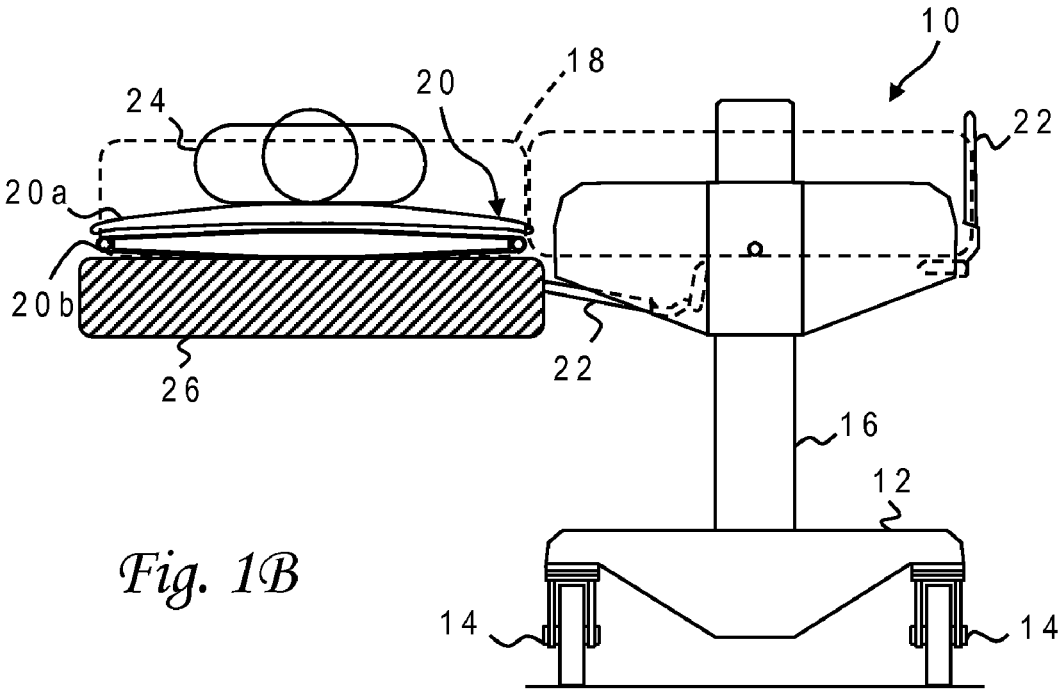

Once the patient is acquired, i.e., generally centered on top of table assembly 20, upper and lower tables 20*a*, 20*b* begin to separate while table assembly 20 remains positioned over bed 26. FIG. 1B shows table assembly 20 with an initial separation between upper and lower tables 20*a*, 20*b* while supporting the patient. As the upper and lower tables separate, left and right edge rollers of upper table 20*a* also retract, as described below in conjunction with FIGS. 3A-3C.

Figure 1C:
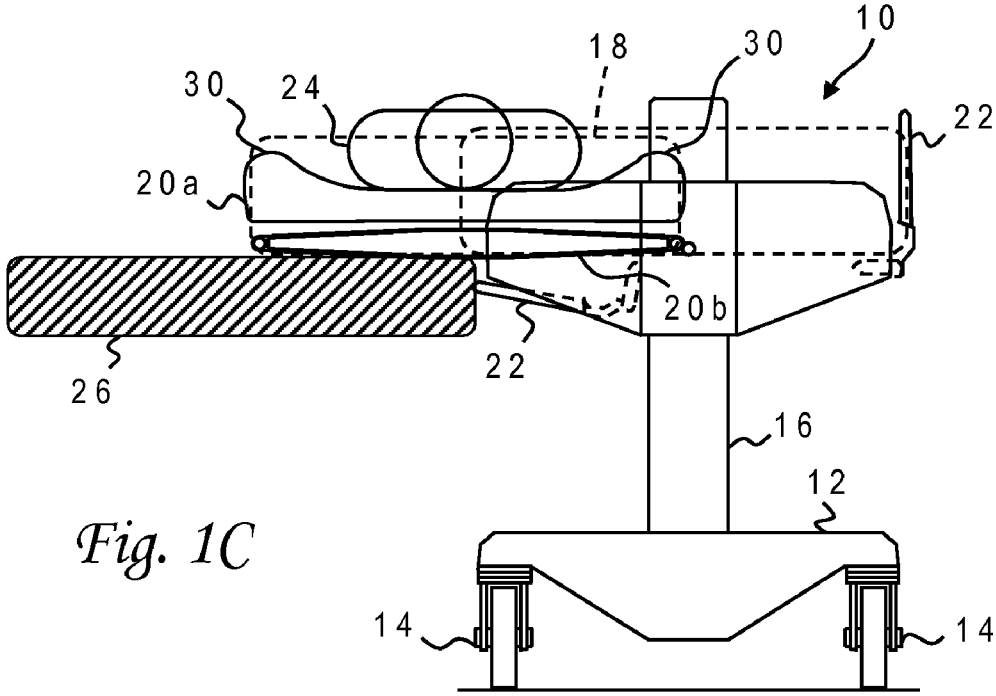

This retraction of the upper table edge rollers introduces slack into the upper belt which allows a shaped air mattress within upper table 20*a* to be inflated. FIG. 1C depicts table assembly 20 with the upper and lower tables 20*a*, 20*b* fully separated and the air mattress inflated to its full shape by which side lobes 30 are formed in the upper belt. Side lobes 30 help prevent patient 24 from rolling off table assembly 20 as it moves to the home position, as well as during transport using patient transfer device 10. As further explained below, left and right edge sections of upper table 20*a* also change their downward inclination to a horizontal orientation which additionally raises side lobes 30 for patient transfer.

The separation of the belt tables now allows the lower belt around lower table 20*b* to roll effortlessly as it is driven in the reverse direction over the top surface of bed 26 while table assembly 20 moves toward the home position without engaging upper belt 20*a*, which would otherwise disrupt patient 24. The contact maintained between lower table 20*b* and bed 26 imparts stability so patient transfer device 10 will not tip over from the lateral weight of the patient as table assembly 20 moves back to the home position illustrated by FIG. 1D. This feature thus allows base 12 to be relatively narrow, i.e., the width of table assembly 20, without any portion of the base extending underneath bed 26. This design still takes advantage of counter-rotating belts to reduce frictional engagement while loading or unloading, but leaves the patient undisturbed on the upper table portion as the patient is safely transferred from the bed to the device.

Figure 1D:
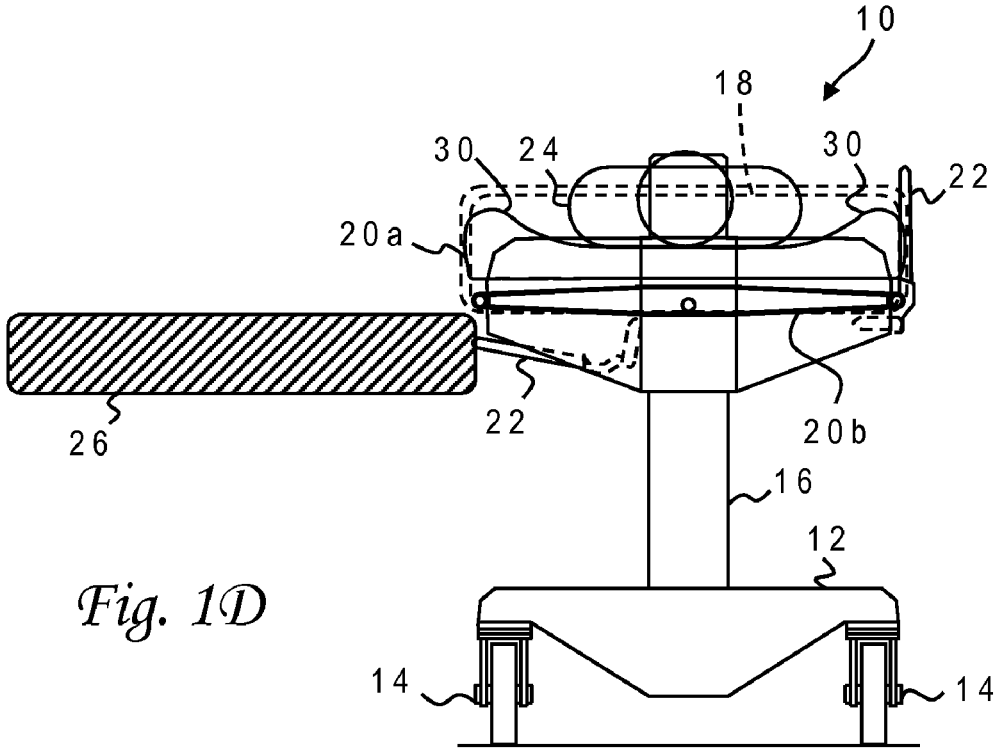

Once the patient is acquired and in the home position shown in FIG. 1D, side rails 22 are raised and patient transfer device 10 can be wheeled to another location and the patient delivered onto a support surface such as an operating table or another bed by simply reversing the acquisition process described above. The patient may be placed along either side of device 10, and the carriage slide in slide assembly 18 may include extensions such that the entire table assembly can move laterally up to 43" to the right or left for a device that can move a 500 lb. patient. Similar devices can be built to transfer bariatric patients, and in these devices, the right or left extension of the slide assemblies will be greater. Device 10 may have multiple transportation modes, and is preferably provided with a pivoting handle to control steering such that a light pressure will make the device turn slightly while continuous force on the handle will make the device turn sharply at a 90° angle, such as for parking the device along a wall of a hallway or room. Various details relating to the construction of base 12, support columns 16, and slide assembly 18, the steerage of wheels 14, designs for the belts, foam padding, slip sheet and air mattress, exemplary dimensions, and other features can be found in U.S. patent application Ser. No. 11/246,426 which is hereby incorporated.

Figure 2:
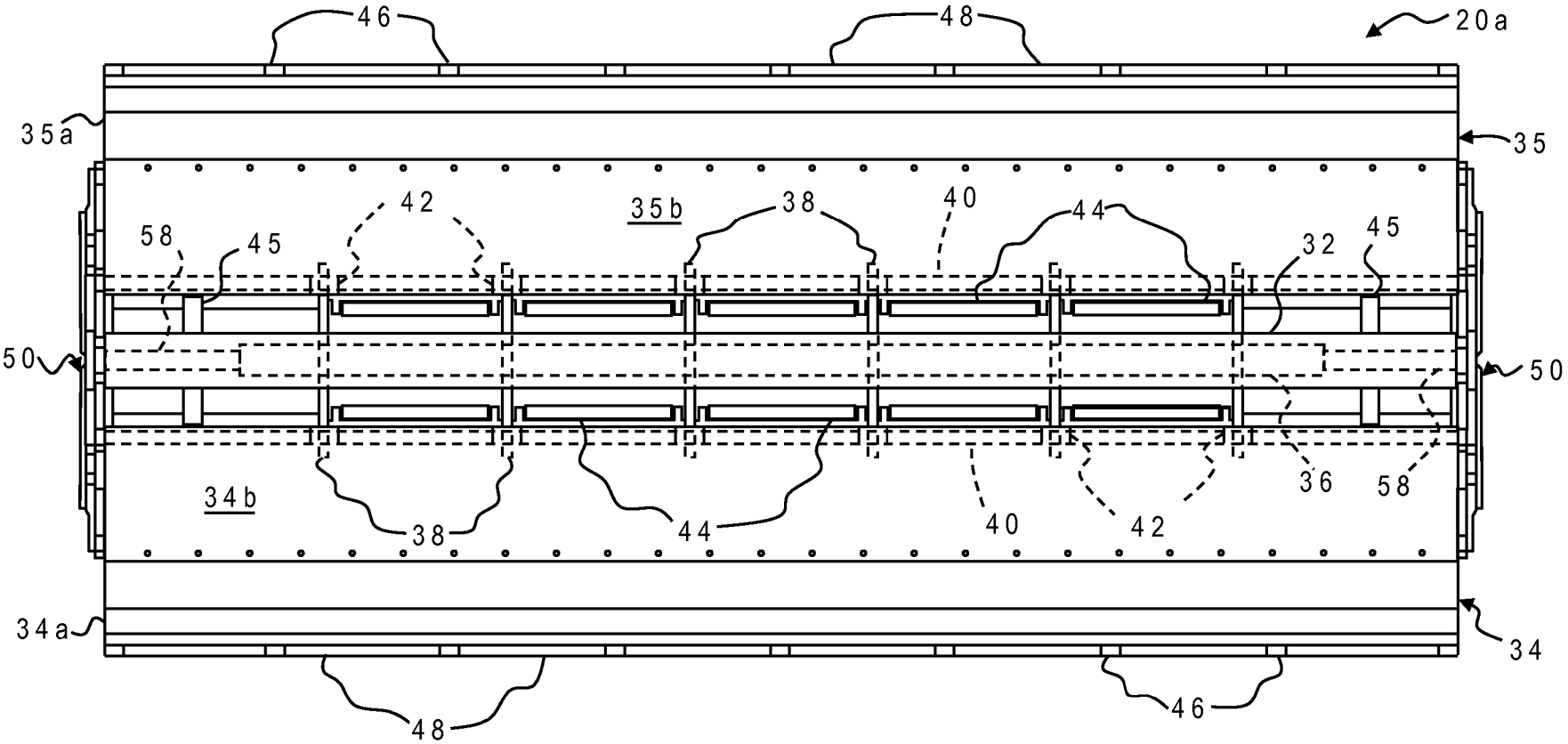
FIG. 2 is a top plan view of the table assembly used with the patient transfer device of FIG. 1 in accordance with one embodiment of the present invention, with the upper belt removed.

Referring now to FIG. 2, there is depicted a top plan view of upper table 20*a* with the upper belt removed to reveal internal details. In this embodiment, the primary patient support members of upper table 20*a* are a fixed central plate section 32, a movable left side plate section 34, and a movable right side plate section 35, each of which generally extends the full length (75") of upper table 20*a*. Plate sections 32, 34 and 35 are made of extruded aluminum. Central plate section 32 has a flat upper surface and two curved walls depending from its lower surface defining a semi-tubular channel 36. Central plate section 32 is 2.875" wide, nominally 0.25" thick, and channel 36 has an effective diameter of 1.125".

Left side plate section 34 is constructed of two separate portions 34*a*, 34*b* held together by screws and interlocking surfaces, and right side plate section 35 is similarly constructed of two separate portions 35*a*, 35*b* (in an alternative embodiment the side plate sections are unitary structures). The edge portions 34*a*, 35*a* have generally wedge-shaped transverse cross-sections and include integrally formed fingers 46 which support the axles of a plurality of edge rollers 48. The size of fingers 46 and edge rollers 48 is relatively small, e.g., 0.625" in diameter, and the thinnest region of edge portions 34*a*, 35*a* (which overlies edge rollers in lower table 20*b*) is 0.3" thick, which together present less of a bump as the patient is acquired or delivered. Edge rollers 48 are made of aluminum tubing and are 8.5" long. In the depicted embodiment there are sixteen edge rollers 48, i.e., eight along the left edge and eight along the right edge. The interior portions 34*b*, 35*b* also have generally wedge-shaped cross-sections but are slightly larger and hollow to reduce weight and accommodate the frame ribs described below when the side plate sections are retracted. Interior portions 34*b*, 35*b* have semi-tubular channels 40 formed therein near their inside edge. The walls of interior portions 34*b*, 35*b* are nominally 0.15" thick, channels 40 are 0.75" in diameter, and the maximum overall thickness of the wedge profile is 1.25". Each side plate section 34, 35 is 12" wide, and in the fully extended position of the side plate sections upper table 20*a* is 32" wide.

Holes are formed along the side walls of channel 36 to receive six transverse ribs 38 which are held in place with metal clips. The ends of ribs 38 also pass through channels 40 in interior portions 34*b*, 35*b* of the side plate sections and are secured by bearings 42 which loosely slide into channels 40 with sufficient tolerance to allow movement of the side plate sections. Ribs 38 are made of aluminum rods and are 8.5" long and 0.375" in diameter. The inside edges of interior portions 34*b*, 35*b* have integrally-formed flanges which support the axles of a plurality of pinch rollers 44. The flanges are inclined toward the bottom of upper table 20*a* so that pinch rollers 44 are in contact with the inside surface of the bottom portion of the upper belt. Pinch rollers 44 are made of aluminum tubing, and are 0.625" in diameter and 8.5" long. In the depicted embodiment there are ten pinch rollers 44, i.e., five on each side equidistant from the centerline of upper table 20*a*. Air tubes 45 are attached near the ends of central plate section 32 for filling the air mattress.

Figure 3A:
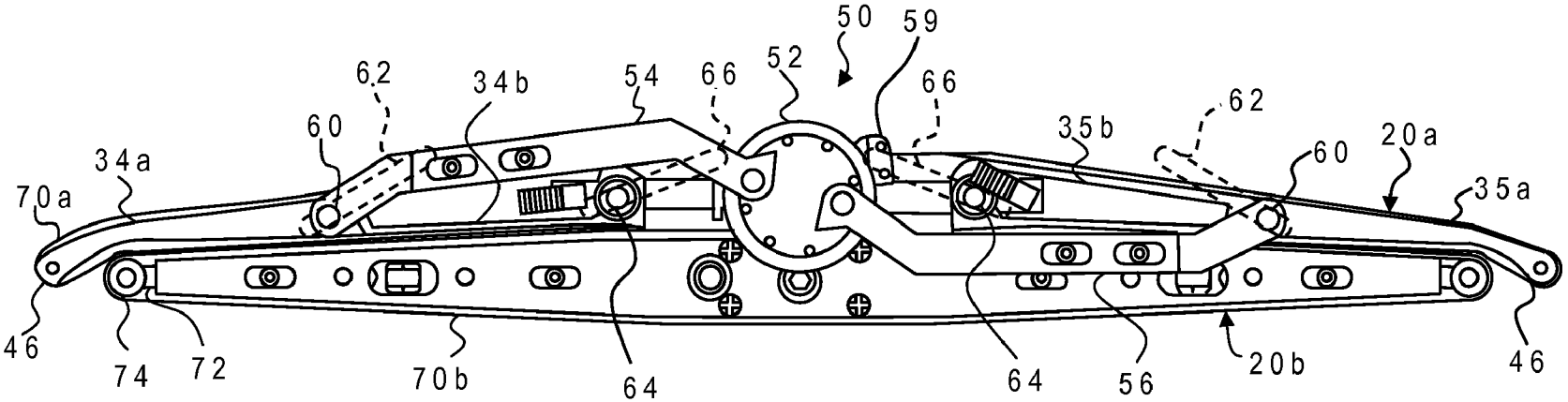
FIGS. 3A-3C are front elevational views of the table assembly of FIG. 2 illustrating (i) the upper table with fully extended edge rollers and the upper belt in forcible contact with the lower belt, (ii) an intermediate separation of the upper table from the lower table with the upper table edge rollers beginning to retract, and (iii) the fully retracted and separated upper table.
Figure 3B:
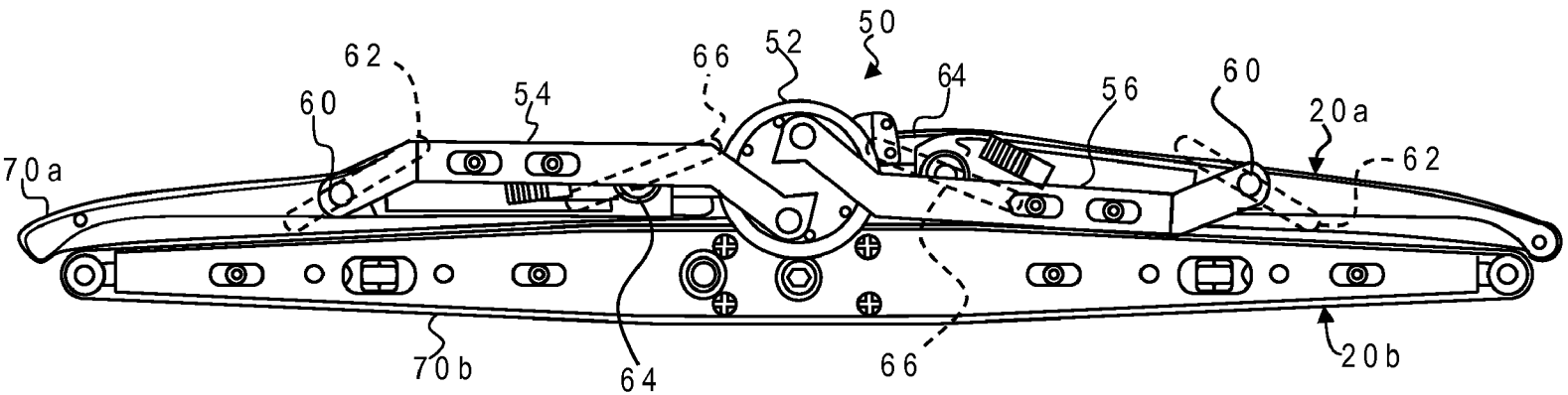
Figure 3C:
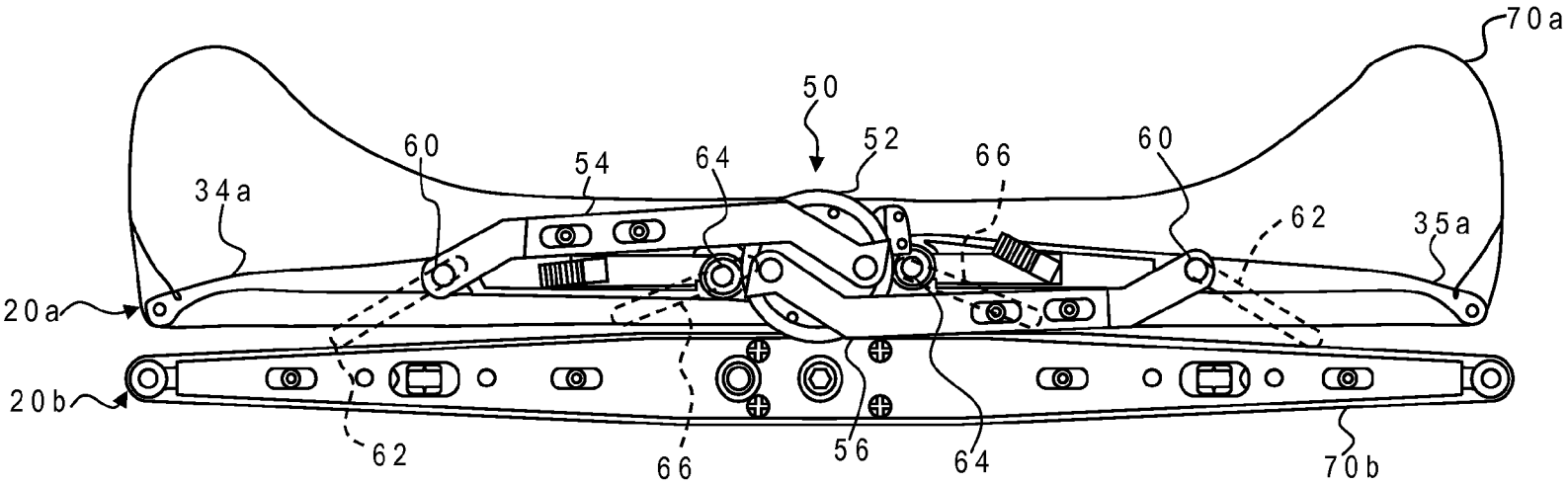

With further reference to FIGS. 3A-3C, left and right side plate sections 34, 35 are extended outwardly or retracted inwardly by the action of crank assemblies 50 located at the front and rear ends of upper table 20*a*. Each crank assembly 50 includes a rotating disk 52, a left linkage arm 54 and a right linkage arm 56. Disk 52 is constructed of steel, is 3" in diameter, and houses a 4:1 planetary gear drive coupled to an output shaft that is further connected to a planetary gear of a respective electric motor 58 (FIG. 2). The housing around the output shaft is inserted into an end of channel 36 in central plate section 32. In the exemplary embodiment motors 58 are 30 mm planetary gear motors manufactured by Dunker Motors (a division of Alcatel-Lucent in Bonndorf, Germany) with a torque of 1.8 N-m, and are responsive to an electronic control system which can selectively instruct the motor shaft to rotate at various speeds either clockwise or counterclockwise. Although the preferred embodiment provides such electronic actuation of the gears in disks 52, those skilled in the art will appreciate that the gears may alternatively be driven manually through appropriate mechanical linkages to a crank handle. It is desirable, but not necessary, to provide crank assemblies at each end to drive the side plate sections. Linkage arms 54, 56 may have a protrusion or beak portion which engages a switch sensor 59 mounted near disk 52 to provide feedback to the control electronics regarding the current position/orientation of disk 52.

Each linkage arm 54, 56 is preferably comprised of two separate pieces which are attached with pairs of bolts inserted in slots to provide some tolerance during the assembly of upper table 20*a*. The linkage arm pieces are constructed of aluminum. Linkage arms 54, 56 are pivotally attached at one end to a peripheral region of disk 52 such that, as disk 52 rotates, the attached end of a given linkage arm moves from one side of the disk to the other side. The plane of rotation of disk 52 is the same as the plane of movement of linkage arms 54, 56, viz., a vertical plane generally located at an end of table assembly 20. The ends of linkage arms 54, 56 attached to disk 52 are bent in opposite directions to accommodate their widths as the disk turns to an extreme rotation point, i.e., the pivotally attached end of linkage arm 54 is bent downward and the pivotally attached end of linkage arm 56 is bent upward, each at an angle of 45° with respect to the main extent of the linkage arms. Linkage arms 54, 56 have an effective length of 10". The other ends of linkage arms 54, 56 are pivotally attached to outer positioning posts 60. Posts 60 are press fit into the ends of respective left and right side plate sections 34, 35 at an outer point thereof (near the boundary between the edge portion and the interior portion). Thus, as disk 52 rotates clockwise or counter-clockwise, linkage arms 54, 56 pull or push left and right side plate sections 34, 35 via posts 60, thereby laterally retracting or extending edge rollers 48. Linkage arms have a stroke length of 1.875".

Figure 4:
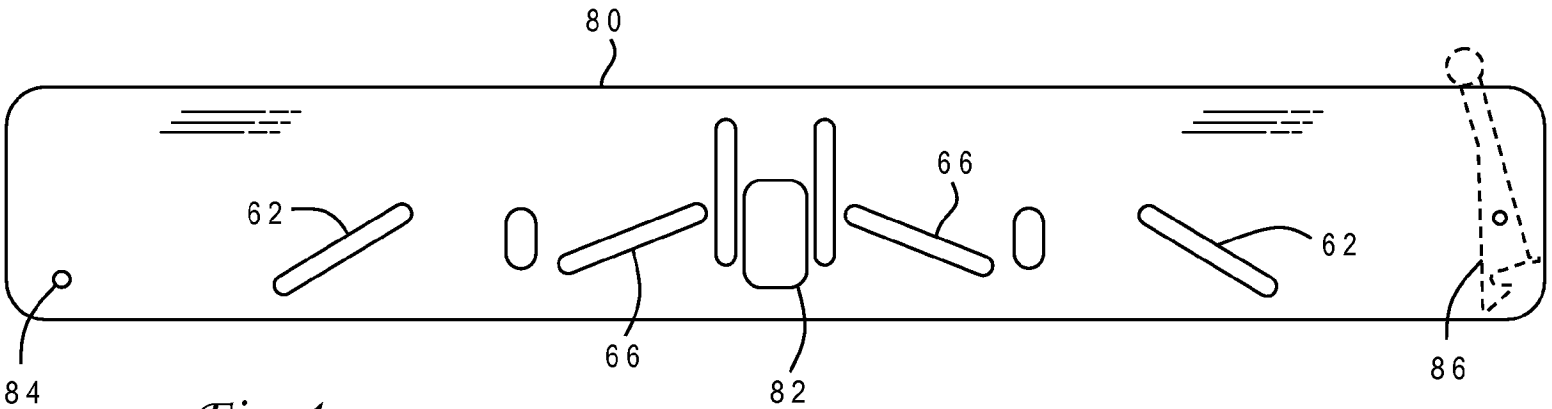
FIG. 4 is a front elevational view of the upper table end plate having guide slots which slidably retain positioning posts attached to ends of the retracting side plates in the upper table.

Outer positioning posts 60 pass through and are slidably retained by slots 62 formed in end plates of upper table 20*a*. One end plate 80 is shown in FIG. 4. Another pair of inner positioning posts 64 slide into lengthwise bores in side plate sections 34 and 35 and are attached with screws to the ends of respective channels 40 in left and right side plate sections 34, 35. Posts 64 pass through and are slidably retained by another pair of slots 66 formed in end plate 80. The position and orientation of left and right side plate sections 34, 35 are accordingly limited by guide slots 62, 66. End plate 80 also has a larger slot 82 which slidably receives a bushing of motor 58 mounted adjacent to disk 52. Other slots or holes may be provided for passage of electrical wiring or pneumatic tubes. End plate 80 is pivotally attached to slide assembly 18 by a pin which passes through a hole 84 at one corner, while a latch 86 mounted at the other corner releasably secures end plate 80 to another pin of slide assembly 18. In this manner, the entire upper table 20*a* can be rotated upwardly 90° for cleaning or maintenance of the table assembly. End plate 80 is constructed of aluminum, and is 32.75" long, 4.5" wide and 0.25" thick.

FIG. 3A illustrates the almost fully extended position of side plate sections 34, 35 wherein fingers 46 and edge rollers 48 project 1.3" beyond the edges of lower table 20*b*. In this position, upper table 20*a* is in forcible contact with lower table 20*b*, that is, pinch rollers 44 are forcibly pressing upper belt 70*a* against lower belt 70*b* and opposing drive rollers inside lower belt 70*b*, such that any movement of the lower belt 70*b* will in turn drive the upper belt 70*a* through the frictional engagement of the belts' outer surfaces. Lower table 20*b* contains an internal framework (not shown) to which are mounted sets of belt support and the drive rollers. The drive rollers are rotated by two small-diameter planetary gear drive motors that are also mounted to the internal framework. The lower table framework is comprised of two trapezoidal-shaped, hollow aluminum extrusions 75" long by 12.5" wide. The thickness of the two extrusions tapers from 1.15" at one edge to 0.5" at the opposite edge. The nominal wall thickness of the extrusions is 0.15". The extrusions are adjustably mounted along their front and rear ends to slide assembly 18. The adjustable mounting for the two extrusions allows them to be moved laterally closer for installation of lower belt 70*b* and then moved apart for tensioning of lower belt 70*b*.

Eight roller supports 72 having a common shaft are positioned at regular intervals along the outside edge of each aluminum extrusion, and support seven drive rollers 74 on each side of lower table 70*b*. Drive rollers 74 are rubber covered, 8.75" long, and 0.774" in diameter. Each drive roller 74 contains a timing belt pulley located at one end. The pitch diameter of the timing belt pulley is selected so that the outside surface of a timing belt operating in the pulley is the same as the diameter of the rubber coating on the roller (0.774"). The thicker (inner) edge of each aluminum extrusion also contains seven bearing support blocks for mounting a second set of six larger diameter, rubber-covered drive rollers along an inner corridor of lower table 20*b*. An open space is left in this corridor at one end of the extrusion for mounting a drive motor. The inner drive rollers are 8.75" long and 1.729" in diameter. A single drive shaft passes through all six inner drive rollers and the seven bearing blocks attached to one extrusion. The drive rollers are keyed to the drive shaft so rotation of the shaft positively drives all of the rollers. Each drive shaft is coupled to a respective 1.653" outside diameter planetary gear motor, and torque restraints attach the motors to the wide edge of the extrusion. The drive motors are located in the open spaces at opposite side ends of the extrusions, with their output shafts oppositely directed. The drive rollers also contain a timing belt pulley at each end, aligned with the timing belt pulleys on five of the six idler rollers 74, so the timing belts can operate between these pulleys. Rotation of the planetary gear drive motor thus causes the drive shaft to rotate which in turn causes the drive rollers to rotate. Rotation of the drive rollers also drives the seven drive rollers 74 through the timing belts, all of which causes lower belt 70*b* to rotate.

Lower belt 70*b* may be provided with two flexible, inwardly-projecting V-shaped ribs, one near each end. The ribs ride in matching grooves formed in both ends of the aluminum extrusions, and also in matching grooves formed on the outer surfaces of four of the idler rollers 74 (at the four comers of lower table 20*b*). This arrangement prevents lower belt 70*b* from inadvertently tracking toward one end or the other as it is driven by the sets of idler and drive rollers. Plates constructed of a low friction material such as ultra-high molecular weight polyethylene may be mounted to the lower side of each aluminum extrusion between the timing belts to reduce the tension in the belt generated by sliding friction when table assembly 20 moves across a mattress or table surface.

When the patient is first acquired as shown in FIG. 1A, upper table 20*a* is in the fully extended position illustrated in FIG. 3A. In this position, the incident angle of the table assembly as it approaches the patient (i.e., the angle between the plane formed by the left side bottom of lower table 20*b* and the plane formed by the leading portion of left side plate section 34) is in the range of 7°-10°. Lower belt 70*b* rotates in response to the drive mechanism in lower table 20*b*, and drives upper belt 70*a* as table assembly 20 crawls under the patient. The timing of the belts' rotation (eversion rate) is synchronized with the lateral movement of slide assembly 18.

Once the patient is positioned over the center of table assembly 20, motors 58 begin to actuate crank assemblies 50 which gradually retract side plate sections 34, 35. Since posts 60, 64 must follow guide slots 62, 66 in end plates 80 and since the guide slots are inclined upwardly toward the longitudinal centerline of table assembly 20, the retraction of left and right side plate sections 34, 35 also results in raising the side plate sections. As side plate sections 34, 35 rise, they lift ribs 38 which in turn raise central plate section 32, thereby separating upper table 20*a* from lower table 20*b*. An intermediate position with partial retraction of left and right side plate sections 34, 35 and partial separation of upper and lower tables 20*a*, 20*b* is shown in FIG. 3B. Disk 52 has rotated to bring the pivotally attached ends of linkage arms 54, 56 to a lateral centerline of disk 52, one above and one below. In this position, fingers 46 and edge rollers 48 of upper table 20*a* barely extend over the edge of lower table 20*b*, and there is significant slack in upper belt 70*a* although it is still in loose contact with lower belt 70*b*.

Outer guide slots 62 have a slightly higher angle of inclination (26°) than inner guide slots 66 (18°), so retraction of left and right side plate sections 34, 35 also results in lowering the inclination of the side plates, i.e., posts 60 will move vertically at a faster rate than posts 64. This action generally flattens the patient support surface of upper table 20*a* to make it more stable and reduce the likelihood of the patient rolling off to one side. The side plate inclinations continue to change as crank assemblies 50 rotate further until table assembly 20 reaches the fully retracted/separated position illustrated in FIG. 3C. Disk 52 has rotated further to bring the pivotally attached ends of linkage arms 54, 56 to opposing sides of disk 52, i.e., the end of left linkage arm 54 is at the right periphery of disk 52 and the end of right linkage arm 56 is at the left periphery of disk 52. Posts 60, 64 have moved to the inward ends of guide slots 62, 66. In this position, the upper surfaces of side plates 34, 35 are advantageously inclined only 2° from the horizontal, although they could be perfectly flat or even slightly inclined upward. Guide slots 62, 66 are 2.75" long, allow maximum lateral movement of each side plate section by 2.4" although the crank stroke is only 1.875", and result in maximum vertical movement of edge rollers 48 by 1.25".

This construction thus provides the integrated and synchronized movement of (i) the retraction of the side plate sections, (ii) the separation of the upper and lower tables, and (iii) the adjustment of the angle of the side plate sections. The result is smoother patient acquisition, and more comfortable and safe patient transport. While other means may be provided to achieve these actions such as gears, cams or 4-bar linkages, the use of end plates having guide slots with positioning posts on the side plate sections has fewer moving parts and can drive all the actions with only two motors for the crank assemblies.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. It is therefore contemplated that such modifications can be made without departing from the spirit or scope of the present invention as defined in the appended claims.

What is claimed is:

1. A patient transfer device comprising:

a base;

at least one support member attached to said base;

a slide assembly attached to said support member, movable between a home position over said base and an extended position to a side of said base; and a table assembly attached to said slide assembly, having upper and lower tables surrounded by respective upper and lower belts which counter-rotate as said table assembly moves between a patient and a surface supporting the patient, and having integrated means for laterally retracting at least one side plate of said upper table while vertically separating said upper table from said lower table, wherein said lower table is fixed to said slide assembly, and said integrated means includes at least one end plate attached to said slide assembly, said end plate having at least one guide slot therein inclined upwardly toward a longitudinal centerline of said table assembly, and at least one positioning post attached to an end of said side plate, said positioning post being slidably retained in said guide slot.

2. The patient transfer device of claim 1 wherein said integrated means further includes a crank assembly with a rotating disk and at least one linkage arm having a first end pivotally attached to a peripheral region of said disk and a second end pivotally attached to said positioning post.

3. The patient transfer device of claim 2 wherein said side plate supports a plurality of transverse ribs, said ribs being attached to a central plate of said upper table such that retraction of said side plate raises said central plate.

4. The patient transfer device of claim 1 wherein said integrated means retracts said side plate and separates said upper and lower tables while further adjusting an incident angle of said side plate.

5. A patient transfer device comprising:

a base;

at least one support member attached to said base;

a slide assembly attached to said support member, movable between a home position over said base and an extended position to a side of said base; and a table assembly attached to said slide assembly, having upper and lower tables surrounded by respective upper and lower belts which counter-rotate as the table moves between a patient and a surface supporting the patient, and having integrated means for laterally retracting at least one side plate of said upper table while adjusting an incident angle of said side plate, wherein integrated means includes at least one end plate attached to said slide assembly, said end plate having at least two guide slots therein and said guide slots having different angles of inclination, and at least two positioning posts attached to an end of said side plate, said positioning posts being slidably retained in said guide slots.

6. The patient transfer device of claim 5 wherein said integrated means further includes a crank assembly with a rotating disk and at least one linkage arm having a first end pivotally attached to a peripheral region of said disk and a second end pivotally attached to one of said positioning posts.

7. The patient transfer device of claim 5 wherein an outer edge of said side plate is downwardly inclined when said side plate is in an extended position and is generally flat when said side plate is in a retracted position.

8. The patient transfer device of claim 5 wherein said integrated means retracts said side plate of said upper table and adjusts the incident angle of said side plate while further vertically separating said upper table from said lower table.

9. A patient transfer device comprising:

a base;

at least one support member attached to said base;

a slide assembly attached to said support member, movable between a home position over said base and an extended position to a side of said base; and a table assembly attached to said slide assembly, having upper and lower tables surrounded by respective upper and lower belts which counter-rotate as the table moves between a patient and a surface supporting the patient, and having integrated means for retracting at least one side plate of said upper table while separating said upper table from said lower table and adjusting an incident angle of said side plate, wherein said lower table is fixed to said slide assembly, and said integrated means includes at least one end plate attached to said slide assembly, said end plate having at least two guide slots therein and said guide slots being inclined upwardly toward a longitudinal centerline of said table assembly at different angles, and at least two positioning posts attached to an end of said side plate, said positioning posts being slidably retained in said guide slots.

10. The patient transfer device of claim 9 wherein said integrated means further includes a crank assembly with a rotating disk and at least one linkage arm having a first end pivotally attached to a peripheral region of said disk and a second end pivotally attached to one of said positioning posts.

11. The patient transfer device of claim 10 wherein said side plate supports a plurality of transverse ribs, said ribs being attached to a central plate of said upper table such that retraction of said side plate raises said central plate.

12. The patient transfer device of claim 9 wherein an outer edge of said side plate is downwardly inclined when said side plate is in an extended position and is generally flat when said side plate is in a retracted position.

13. A patient transfer device comprising:

a base;

at least one support member attached to said base;

a slide assembly attached to said support member, movable between a home position over said base and an extended position to a side of said base; and a table assembly including a lower table having a lower endless belt, and an upper table having an upper endless belt and at least one side plate section which is movable between an extended position and a retracted position, wherein said side plate section is downwardly inclined and said upper table is in forcible contact with said lower table when said side plate section is in the extended position, and said side plate section is generally flat and said upper table is vertically separated from said lower table when said side plate section is in the refracted position, wherein said lower table is fixed to said slide assembly, and said integrated means includes at least one end plate attached to said slide assembly, said end plate having at least two guide slots therein and said guide slots being inclined upwardly toward a longitudinal centerline of said table assembly at different angles, and at least two positioning posts attached to an end of said side plate section, said positioning posts being slidably retained in said guide slots.

14. The patient transfer device of claim 13 wherein rotation of said lower endless belt drives said upper endless belt when said upper table is in forcible contact with said lower table.

15. The patient transfer device of claim 13 further comprising a crank assembly with a rotating disk and at least one linkage arm having a first end pivotally attached to a peripheral region of said disk and a second end pivotally attached to one of said positioning posts.

16. The patient transfer device of claim 15 wherein said side plate section supports a plurality of transverse ribs, said ribs being attached to a central plate section of said upper table such that retraction of said side plate section raises said central plate section.

17. A table assembly for a patient transfer device having a slide assembly movable between a home position an extended position, the table assembly comprising:

a lower table fixed to the slide assembly, said lower table including a lower endless belt; and an upper table including an upper endless belt which is driven by rotation of said lower endless belt when said upper table is in forcible contact with said lower table, an elongate central plate section, an elongate left side plate section, an elongate right side plate section, a plurality of transverse ribs supported by said left and right side plate sections and attached to said central plate section, inner positioning posts attached respectively to ends of said left and right side plate sections along inner portions thereof, outer positioning posts attached respectively to said ends of said left and right side plate sections along outer portions thereof, an end plate attached to said slide assembly, said end plate having inner guide slots which slidably retain said inner positioning posts and having outer guide slots which slidably retain said outer positioning posts, a rotating disk attached to said central plate section, a left linkage arm having a first end pivotally attached to a first peripheral region of said disk and a second end pivotally attached to one of said positioning posts attached to said left side plate section, and a right linkage arm having a first end pivotally attached to a second peripheral region of said disk and a second end pivotally attached to another one of said positioning posts attached to said right side plate section.

18. A patient transfer device comprising:

a base;

at least one support member attached to said base;

a slide assembly attached to said support member, movable between a home position over said base and an extended position to a side of said base;

a table assembly having upper and lower tables surrounded by respective upper and lower belts which counter-rotate as said table assembly moves between a patient and a surface supporting the patient, wherein said lower table is fixed to said slide assembly, and said upper table has at least one side plate; and at least one end plate attached to said slide assembly, said end plate having at least one guide slot therein inclined upwardly toward a longitudinal centerline of said table assembly, wherein at least one positioning post is attached to an end of said side plate, said positioning post being slidably retained in said guide slot.

19. The patient transfer device of claim 18 wherein said guide slot is a first guide slot, said end plate further has a second guide slot therein having a different angle of inclination than said first guide slot, said positioning post is a first positioning post, and said side plate has a second positioning post attached to said end of said side plate, said second positioning post being slidably retained in said second guide slot.

20. The patient transfer device of claim 18 wherein said slide assembly is a first slide assembly located at a first end of said table assembly, and said end plate is a first end plate, and further comprising:

a second slide assembly located at a second end of said table assembly, movable between the home position over said base and the extended position to the side of said base; and a second end plate attached to said second slide assembly, said second end plate having at least one other guide slot therein inclined upwardly toward the longitudinal centerline of said table assembly, wherein at least one other positioning post is attached to a second end of said side plate, said second positioning post being slidably retained in said other guide slot.

* * * * *